US007624810B2

(12) United States Patent
Fould et al.

(10) Patent No.: US 7,624,810 B2
(45) Date of Patent: Dec. 1, 2009

(54) BALL DROPPING ASSEMBLY AND TECHNIQUE FOR USE IN A WELL

(75) Inventors: Jeremie C. Fould, Perth (AU); Timothy M. O'Rourke, Jakarta (ID); Michael W. Rea, Edmonton (CA); Bryan C. Linn, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/962,308

(22) Filed: Dec. 21, 2007

(65) Prior Publication Data

US 2009/0159297 A1 Jun. 25, 2009

(51) Int. Cl.
*E21B 33/12* (2006.01)
*E21B 33/00* (2006.01)
*E21B 12/02* (2006.01)

(52) U.S. Cl. ..... 166/387; 166/332.5; 166/319; 166/374; 166/66; 175/39; 175/324

(58) Field of Classification Search ..... 166/387, 166/325, 319, 332.5, 374, 66, 67, 328, 75.15; 188/67; 175/39, 324
See application file for complete search history.

(56) References Cited

U.S. PATENT DOCUMENTS

| | | | | |
|---|---|---|---|---|
| 3,011,548 A | | 12/1961 | Holt | |
| 3,054,415 A | | 9/1962 | Baker et al. | |
| 3,269,463 A | | 8/1966 | Page, Jr. | |
| 3,995,692 A | | 12/1976 | Seitz | |
| 4,064,937 A | | 12/1977 | Barrington | |
| 4,355,686 A | | 10/1982 | Arendt et al. | |
| 4,491,177 A | * | 1/1985 | Baugh | 166/75.15 |
| 4,729,432 A | | 3/1988 | Helms | |
| 4,823,882 A | * | 4/1989 | Stokley et al. | 166/387 |
| 5,183,114 A | | 2/1993 | Mashaw et al. | |
| 5,224,044 A | | 6/1993 | Tamura | |
| 5,921,318 A | | 7/1999 | Ross | |

(Continued)

FOREIGN PATENT DOCUMENTS

| | | |
|---|---|---|
| RU | 907225 | 2/1982 |
| RU | 1709078 | 1/1992 |
| RU | 2175713 | 11/2001 |
| RU | 2178065 | 1/2002 |
| WO | WO03095794 | 11/2003 |
| WO | WO04088091 | 10/2004 |

OTHER PUBLICATIONS

Thomson et al., "Design and Installation of a Cost-Effective Completion System for Horizontal Chalk Wells where Multiple Zones require Acid Stimulation," OTC, May 1997.
Houston, TX, SPE 51177 (a revision of SPE 39150).

*Primary Examiner*—Jennifer H Gay
*Assistant Examiner*—Yong-Suk Ro
(74) *Attorney, Agent, or Firm*—James L. Kurka

(57) ABSTRACT

A technique that is usable with a well includes running string that includes a tool and a flowable object that is held in a retained position within the string downhole in the well. After the string is run downhole in the well, the flowable object is released to permit the object to flow in and subsequently seat in a flow path of the string to impede fluid communication so that the tool may be actuated in response to the impeded fluid communication.

20 Claims, 11 Drawing Sheets

U.S. PATENT DOCUMENTS 5,960,881 A * 10/1999 Allamon et al. ..... 166/291
5,988,285 A 11/1999 Tucker
6,059,032 A 5/2000 Jones
6,155,342 A 12/2000 O'Neal
6,216,785 B1 4/2001 Achee, Jr. et al.
6,302,199 B1 * 10/2001 Hawkins et al. ..... 166/70
6,334,486 B1 1/2002 Carmody
6,634,429 B2 10/2003 Henderson et al.
6,997,263 B2 2/2006 Campbell et al.
7,273,096 B2 * 9/2007 Den Boer et al. ..... 166/66
2003/0019634 A1 1/2003 Henderson et al.
2004/0020652 A1 2/2004 Campbell et al.
2004/0118564 A1 6/2004 Themig et al.
2004/0221997 A1 * 11/2004 Giroux et al. ..... 166/380
2006/0124310 A1 6/2006 Lopez de Cardenas et al.
2006/0243455 A1 11/2006 Telfer et al.

* cited by examiner

BALL DROPPING ASSEMBLY AND TECHNIQUE FOR USE IN A WELL

BACKGROUND

The invention generally relates to a ball dropping assembly and technique for use in a well.

Various tools (valves, chokes, packers, perforating guns, injectors, as just a few examples) typically are deployed downhole in a well during the well's lifetime for purposes of testing, completing and producing well fluid from the well. A number of different conveyance mechanisms may be used for purposes of running a particular tool into the well. As examples, a typical conveyance mechanism device may be a coiled tubing string, a jointed tubing string, a wireline, a slickline, etc.

Once deployed in the well, a given tool may be remotely operated from the surface of the well for purposes of performing a particular downhole function. For this purpose, a variety of different wired or wireless stimuli (pressure pulses, electrical signals, hydraulic signals, etc.) may be communicated downhole from the surface of the well to operate the tool.

Another way to remotely operate a downhole tool is through the deployment of a ball from the surface of the well into a tubing string that contains the tool. More specifically, a ball may be dropped into the central passageway of the string from the surface of the well. The ball travels through the string and eventually lodges in a seat of the string to block fluid communication through the central passageway. As a result of the blocked fluid communication, the tubing string may be pressurized for purposes of actuating the tool. The above-described traditional approach of deploying a ball in the string to actuate a tool of the string assumes that, in general, no obstruction exists in the central passageway, which would prevent the ball from traveling from the surface of the well to the seat in which the ball lodges.

SUMMARY

In an embodiment of the invention, a technique that is usable with a well includes running string that includes a tool and a flowable object that is held in a retained position within the string downhole in the well. After the string is run downhole in the well, the flowable object is released to permit the object to flow in and subsequently seat in a flow path of the string to impede fluid communication so that the tool may be actuated in response to the impeded fluid communication.

In another embodiment of the invention, a technique that is usable with a well includes running a packer downhole in the well on a drill string and using a flow modulator of the drill string to communicate an orientation of the packer to the surface of the well. The packer is oriented in response to the communicated orientation, and downhole of the flow modulator, a flowable device is introduced into a central passageway of the string to impede fluid communication through the string. The packer is set in response to the impeded fluid communication.

In another embodiment of the invention, a system that is usable with a well includes a flowable object, a string and a retaining device. The string includes a flow path and a tool that is adapted to be actuated by the flowable object. The retaining device is located in the string and is adapted to retain the flowable object during a run in hole state of the string and be actuated to release the flowable object into the flow path to actuate the tool.

Advantages and other features of the invention will become apparent from the following description, drawing and claims.

DETAILED DESCRIPTION

Figure 1:
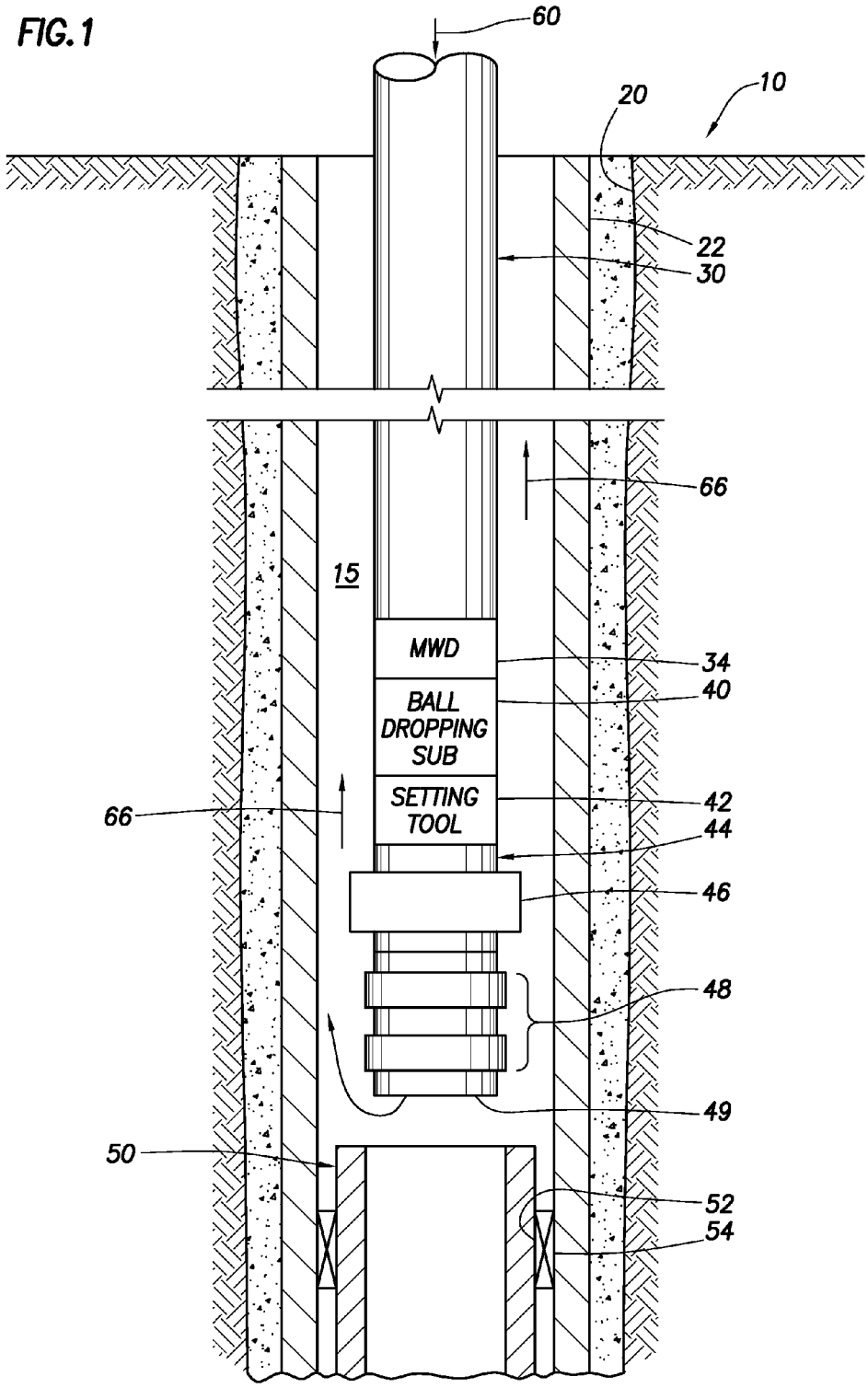
FIGS. 1, 2, 3, 4 and 5 are schematic diagrams of a well illustrating different phases of the well associated with running, orienting and setting an anchor packer in a single trip according to an embodiment of the invention.

Referring to FIG. 1, a tubular drill string 30 (a jointed drill string or a coiled tubing drill string, as non-limiting examples) may be deployed in a well bore 20 of a well 10 for purposes of running, orienting and setting an anchor packer 44 in a single downhole trip. In this regard, the drill string 30 may have been previously used for purposes of forming the wellbore 20, and the drill bit of the drill string 30 has been removed. The drill string 30 includes a lower assembly that includes a measurement while drilling (MWD) assembly 34; a ball dropping assembly, or sub 40; packer setting tool 42; and the packer 44. The MWD assembly 34 is used, as described further below, for purposes of communicating packer orientation data (data indicative of an azimuth of the packer 44, for example) to the surface of the well. Thus, after the packer 44 is run downhole in the vicinity of its setting depth, the drill string 30 may be rotated until the uphole signal communicated by the MWD assembly 34 indicates that the packer 44 is in the proper orientation. When this occurs, the packer setting tool 42 of the drill string 30 is remotely actuated (as described in more detail herein), which causes the tool 42 to set the packer 44, i.e., cause expansion of slips, or dogs, of the packer 44 and causes the radial expansion of one or more annular sealing elements 46 (one sealing element 46 being depicted in FIG. 1) of the packer 44.

Although the MWD assembly 34 is useful for purposes of communicating information related to the orientation of the packer 44 uphole to the surface of the well, the assembly 34 introduces a flow path obstruction for a flowable device (such as a ball, for example) that may otherwise be deployed from the surface of the well through the string 30 for purposes of actuating the packer setting tool 44. In other words, in conventional drill strings, the presence of the MWD assembly 34 prohibits the use of flowable devices, such as balls, for purposes of actuating devices downhole of the assembly 34, such as the packer setting tool 42. However, unlike conventional drill strings, the drill string 30 includes the ball dropping sub 40, which is located below the MWD assembly 34 and thus, is located downhole from the obstruction that is created by the assembly 34.

As described herein, the ball dropping sub 40 is actuated by, for example, annulus pressure (i.e., pressure appearing in an annulus 15 that surrounds the string 30), and when actuated, the ball dropping sub 40 deploys a ball into the central passageway of the string 30. The deployed ball flows downhole in the string 30 until the ball lodges in a valve seat of the drill string 30 (a valve seat that is part of the packer setting tool 42, for example). The lodged ball blocks fluid communication through the central passageway of the string 30 downhole of the seat. Because the packer setting tool 42 is actuated via tubing conveyed pressure, fluid may be introduced into the drill string 30 from the surface of the well for purposes of pressurizing the string 30 to actuate the tool 42.

It is noted that FIG. 1 is merely an example of one of many possible strings that may contain a ball dropping sub, in accordance with many different contemplated embodiments of the invention. Although FIG. 1 depicts the wellbore 20 as being cased by a casing string 22, it is noted that the systems and techniques that are disclosed herein may likewise be used in connection with uncased wellbores.

For the particular example depicted in FIG. 1, a liner hanger 50 has been deployed as part of a lower completion in the wellbore 20, and as shown, the liner hanger 50 is mechanically and sealably (via a seal 54) connected to the inside of the casing string 22. In general, the liner hanger 50 includes a tie back receptacle 52, which is constructed to be stabbed by a lower end 49 of the drill string 30 such that annular seals 48 of the drill string 30 form a seal between the tie back receptacle 52 and the exterior of the drill string 30.

Figure 4:
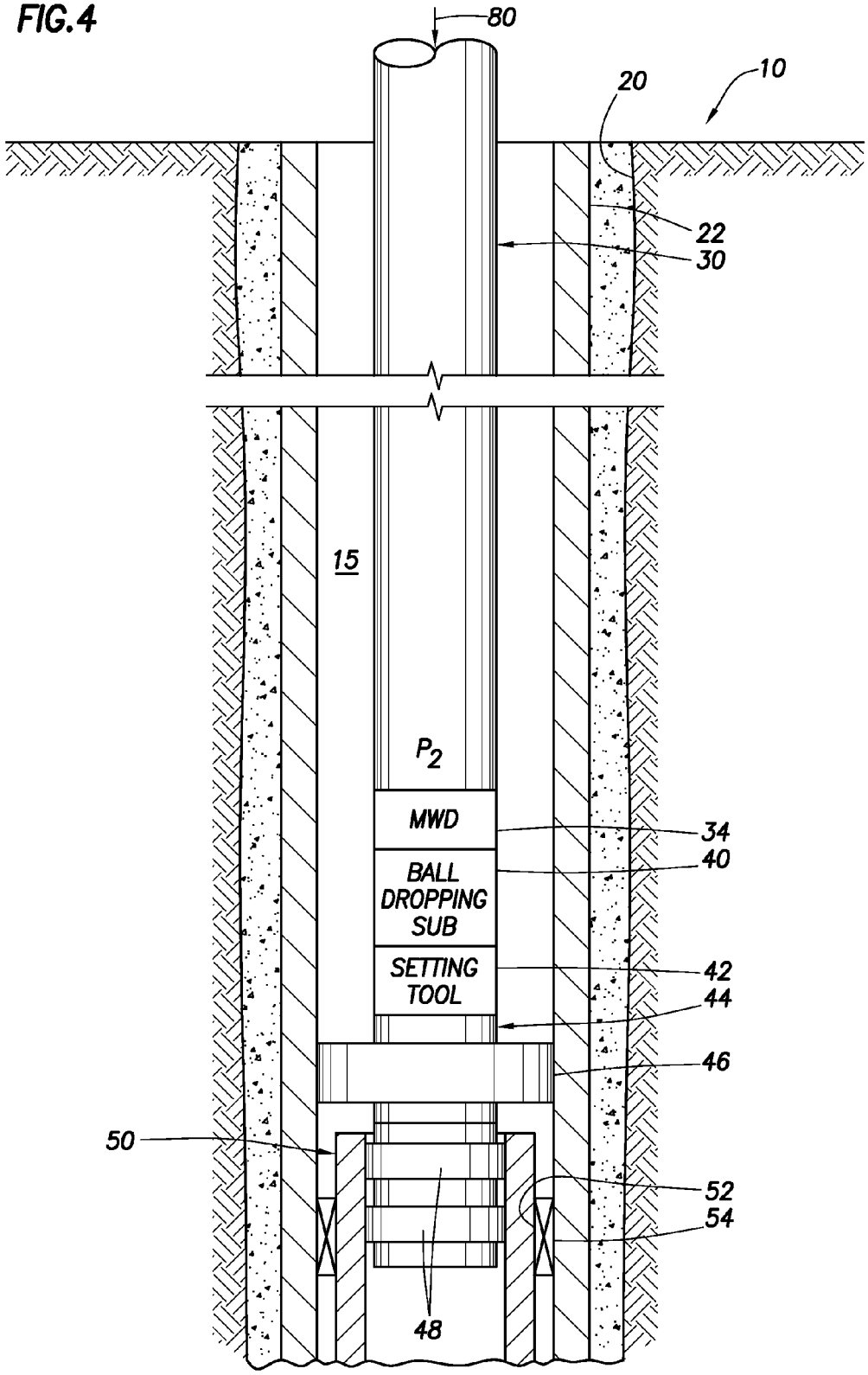
Figure 5:
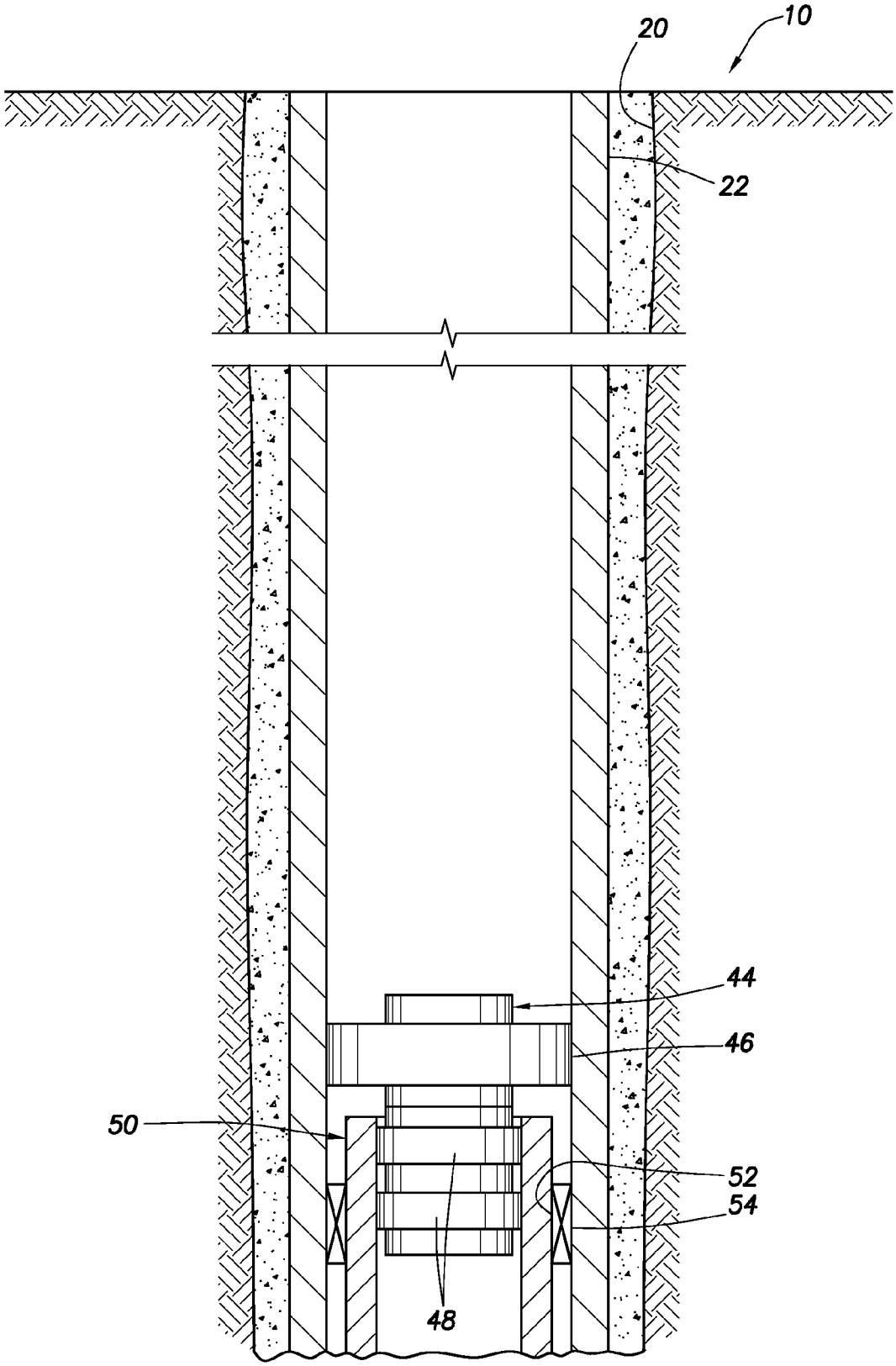
Figure 6A:
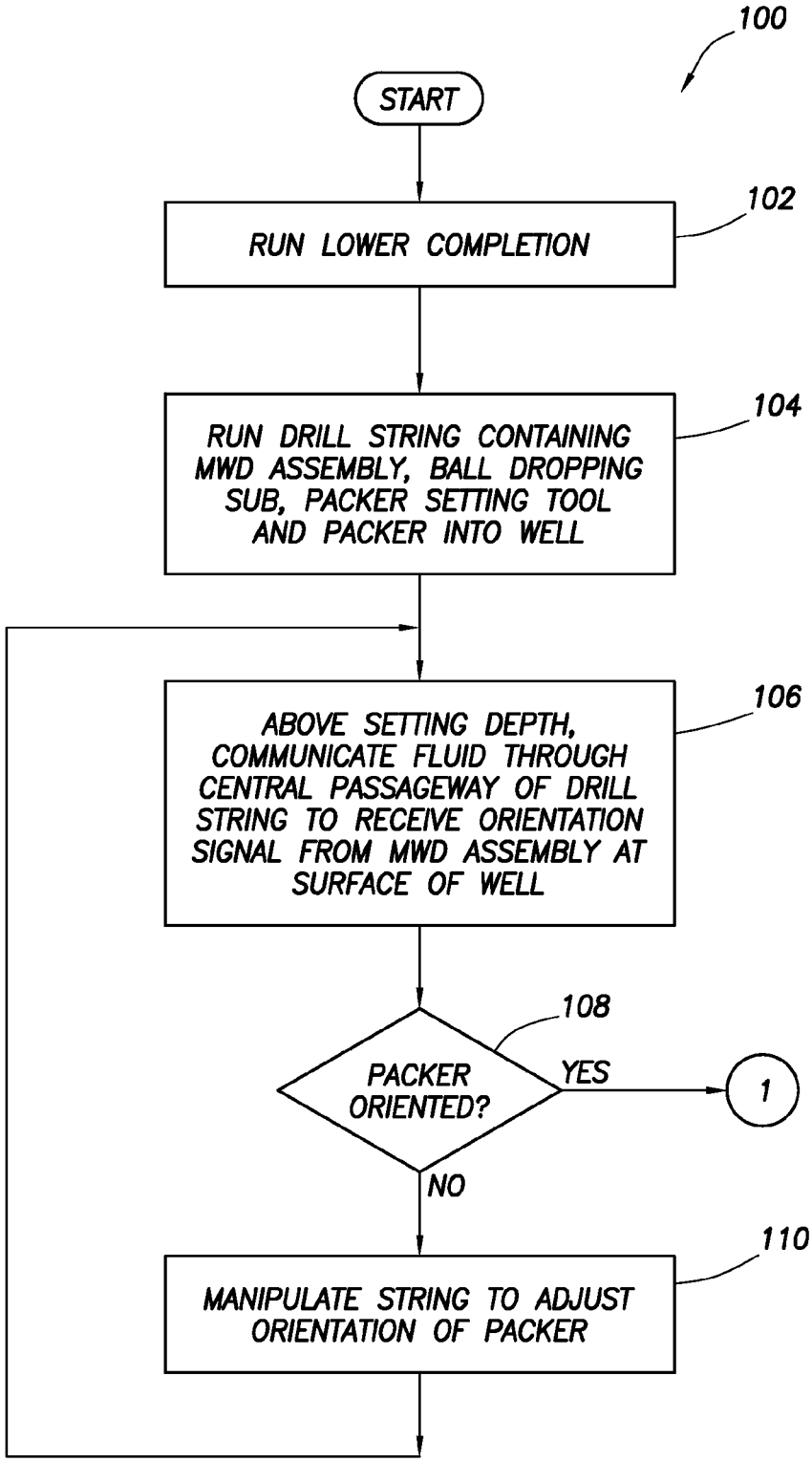
FIGS. 6A and 6B depict a flow chart illustrating a technique to run, orient and set an anchor packer according to an embodiment of the invention.
Figure 6B:
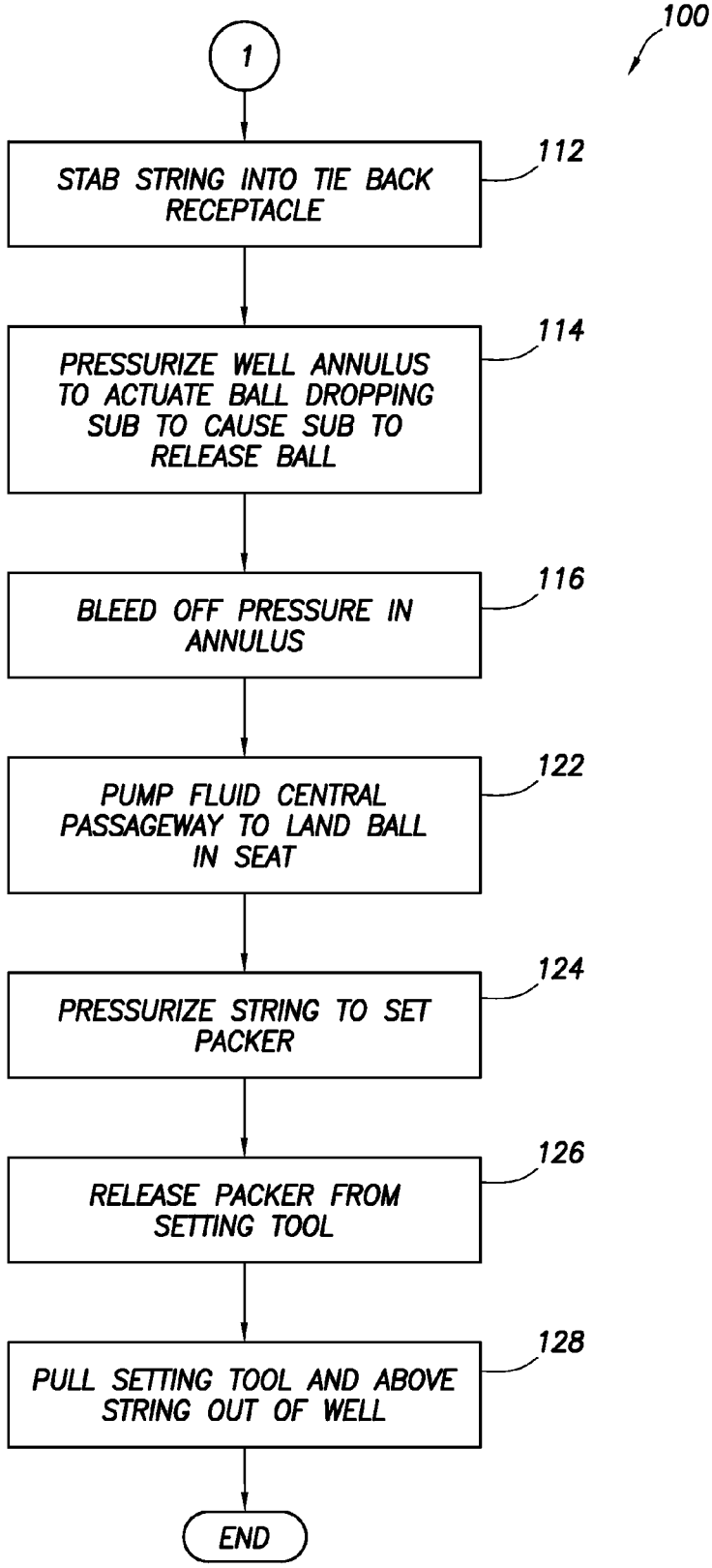

FIGS. 6A and 6B depict a technique 100 to run, orient and set the packer 44 in accordance with some embodiments of the invention; and FIGS. 1-5 depict various phases of the well 10 during the running, orienting and setting operations. Referring to FIG. 6A in conjunction with FIG. 1, the technique 100 includes running (block 102) a lower completion in the well 10. In this regard, the lower completion may include the liner hanger 50, which, in turn, has the tie back receptacle 52. The liner hanger 50 may be pressure tested from the backside before the drill string 30 is run downhole with the packer 44, in accordance with some embodiments of the invention. After the lower completion is run into the well 10, the drill string 30 is run into the well, pursuant to block 104 of the technique 100.

The technique 100 includes, pursuant to block 106, running the drill string 30 downhole such that above the setting depth, fluid is communicated through a primary flow path, or central passageway, of the drill string 30 for purposes of receiving an orientation signal from the MWD assembly 34 at the surface of the well 10. Using the orientation signal that is provided by the MWD assembly, the drill string 30 is manipulated (rotated, for example) at the surface of the well 10, pursuant to block 110, until it is determined (diamond 108) that the packer 44 has the intended orientation.

For the specific example depicted in FIG. 1, before the packer 44 reaches its setting depth but is in the vicinity thereof, the drill string 30 is suspended so that a bottom end 49 of the string 30 is above the tie back receptacle 52. In this position, the drill string 30 is rotated until the packer 44 has the appropriate orientation (e.g., azimuth). For purposes of orienting the packer 44, a fluid flow 60 is introduced at the surface of the well 10 into the central passageway of the drill string 30. The MWD assembly 34 modulates the flow 60 to encode information into the flow regarding the orientation of the packer 44. In this regard, the MWD assembly 34 includes a flow modulator for encoding the orientation into the flow and an orientation sensor, such as a gyroscope, for purposes of determining the orientation. The resulting modulated flow 66 returns via the annulus 15 to the surface of the well 10.

More specifically, pursuant to block 106, when the drill string 30 is above the setting depth of the packer 44, fluid is communicated through the central passageway of the drill string 30 such than an orientation signal is received from the MWD assembly 34 at the surface of the well. Pursuant to diamond 108, a determination is made whether the packer 44 is properly oriented and if not, the drill string 30 is manipulated (block 110) to adjust the orientation of the packer 44. After the packer 44 is oriented, the flow 60 is halted, and the drill string 30 is stabbed into the tie back receptacle 52, as depicted in block 112 (see FIG. 6B) of the technique 100.

Figure 2:
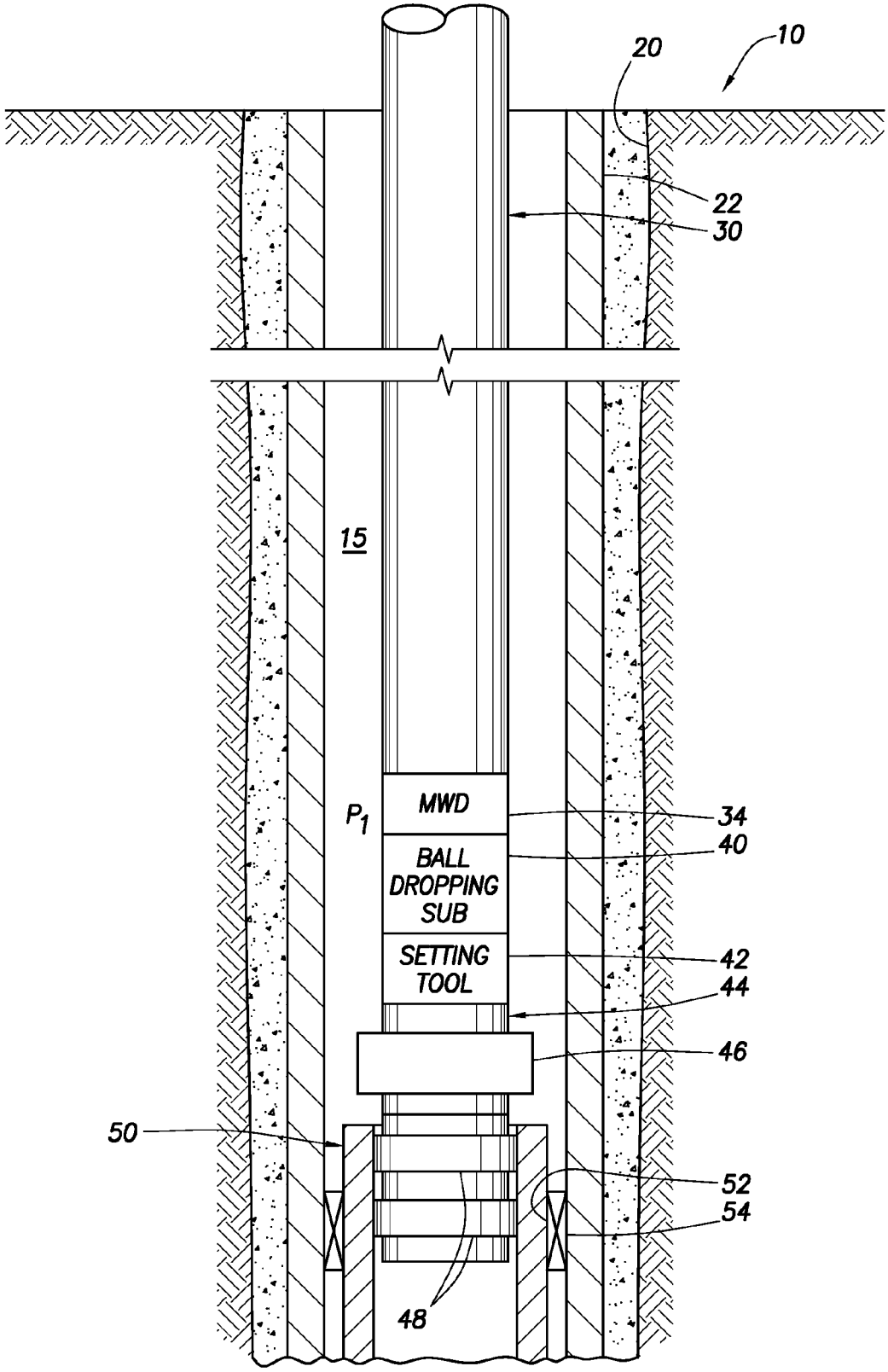

Referring to FIG. 6B in conjunction with FIG. 2, after the drill string 30 is stabbed into the tie back receptacle 52, the annular seals 48 of the drill string 30 complete a seal between the outside of the drill string 30 and the interior surface of the casing string 22. Thus, at this point, the annulus 15 above the liner hanger 50 is isolated from the region of the well below the hanger 50. Measures are then undertaken for purposes of setting the packer 44.

More particularly, in accordance with embodiments of the invention, the well annulus 15 is pressurized (block 114) to a certain pressure threshold (indicated by "$P_1$" in FIG. 2), which actuates the ball dropping sub 40, i.e., causes the ball dropping sub 40 to release a retained ball into the central passageway of the drill string 30. After the actuation of the ball dropping sub 40, the pressure in the annulus 15 is bled off, pursuant to block 116.

Figure 3:
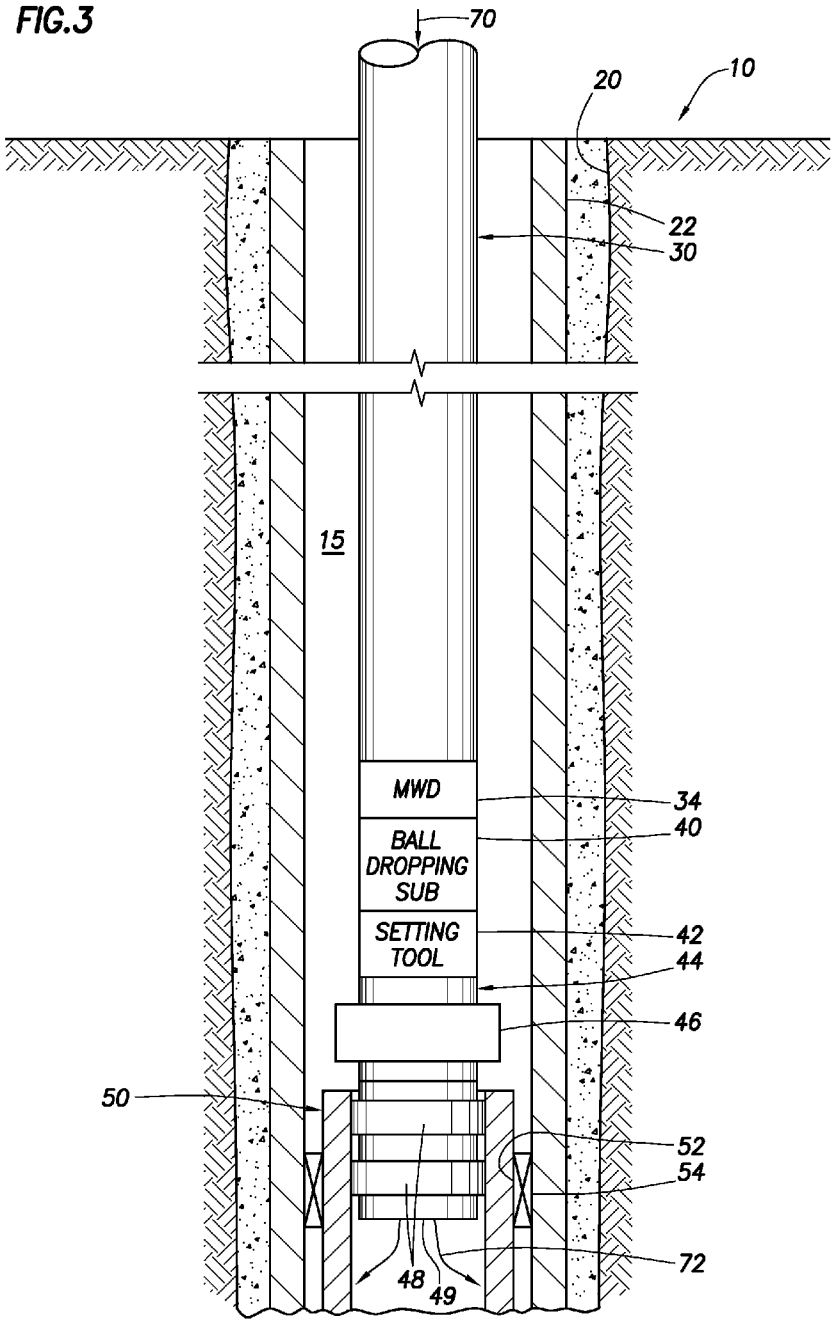

Referring to FIG. 6B in conjunction with FIG. 3, after the pressure in the annulus 15 is bled off, a fluid flow 70 is introduced at the surface of the well 10 for purposes of pumping the deployed ball through the central passageway of the drill string 30 so that the ball descends from the ball dropping sub 40 to a ball seat (not shown) located in the drill string 30 in proximity to or in the setting tool 42. Thus, fluid is pumped through the central passageway of the drill string 30 for purposes of landing the ball in a seat of the string 30, pursuant to block 122 of FIG. 6B. This ball catching seat may be introduced by the packer setting tool 42, in accordance with some embodiments of the invention.

FIG. 3 depicts the drill string 30 as being stabbed into the tie back receptacle 52 during the pumping of the flow 70 into the string 30, which results in an exit flow 72 from the lower end 49 of the string 30. It is noted that the flow 70 may be introduced at a relatively slow rate. However, depending on the particular well configuration, the ball may be landed on the seat by pulling the string 30 uphole to dislodge the seals 48 from the tie back receptacle 52 so that the flow 70 is introduced while the drill string 30 remains slightly above the liner hanger 50. Regardless, however, of whether the flow 70 is introduced while the drill string 30 stabbed into or pulled out of the tie back receptacle 52, the drill string 30 is returned to/left in the tie back receptacle 52 during the next phase, which is depicted in FIG. 4.

Referring to FIG. 6B in conjunction with FIG. 4, after the ball has landed in the seat in the central passageway of the drill string 30, a fluid flow 80 is introduced at the surface of the well for purposes of pressurizing the fluid inside the drill string 30 above a certain pressure threshold (called "$P_2$" in FIG. 4), pursuant to block 124 of FIG. 6B. The tubing pressurization, in turn, actuates the packer setting tool 42 to cause the setting tool 42 to set the packer 44. As can be appreciated by one of skill in the art, the setting of the packer 44 causes the slips, dogs, of the packer 44 to radially expand and grip the interior wall of the casing string 22 (assuming the wellbore 20 is cased) and causes the radial expansion of the seal element(s) 46.

Referring to 6B in conjunction with FIG. 5, after the packer 44 is set, the packer setting tool 42 is operated to release a latch that secures the packer 44 to the setting tool 42 for purposes of releasing the packer 44 from the setting tool 42, pursuant to block 126. As a more specific example, in accordance with some embodiments of the invention, a predetermined mechanical movement of the drill string 30 may cause the setting tool 42 to release the packer 44.

Alternatively, the packer setting tool 42 may release the packer 42 in response certain wired and/or wireless stimuli that are communicated downhole from the surface of the well 10, as another non-limiting example. After the packer 44 is released from the packer setting tool 42, the setting tool 42 and the remaining part of the drill string above the setting tool 42 are pulled out of the well 10, pursuant to block 128, which leaves the packer 44 and liner hanger 50 in the well 10, as depicted in FIG. 5.

The packer 44 is an example of one of many possible tools that may be run downhole, oriented and actuated, in accordance with embodiments of the invention. For example, in accordance with other embodiments of the invention, the packer 44 may be replaced by an oriented perforating gun, whipstock, etc. Additionally, the techniques and systems that are described herein are likewise applicable to overcoming obstructions other than the obstruction introduced by a flow modulator. As another example, the drill string 30 may include a section that has a reduced inner diameter that is sufficiently small to prohibit a ball from passing through the section. Thus, many variations are contemplated and are within the scope of the appended claims.

Figure 7:
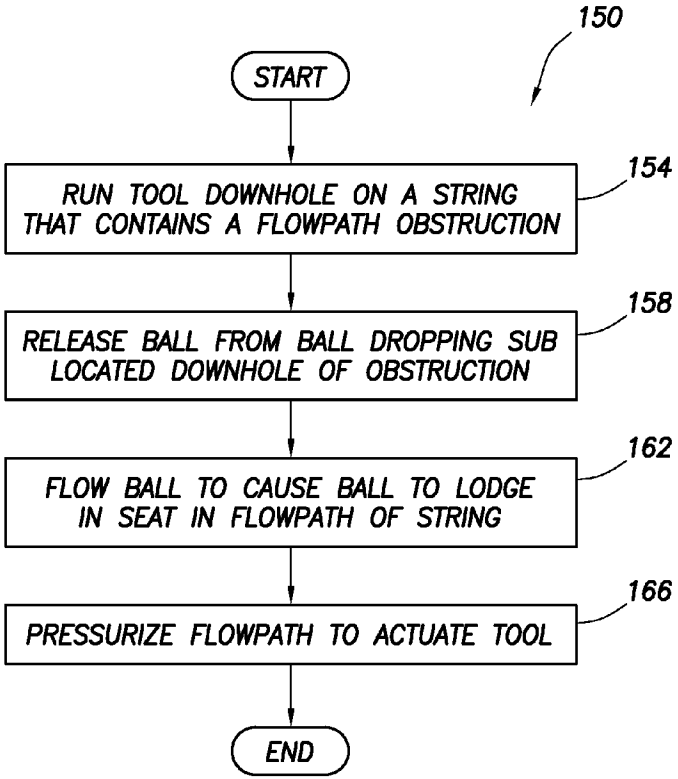
FIG. 7 is a flow diagram depicting a technique to use a ball to actuate a downhole tool when an obstruction to the ball exists in a string that contains the tool according to an embodiment of the invention.

Referring to FIG. 7, to summarize, a technique 150 may be used for purposes of using a flowable device, such as a ball, to actuate a downhole tool for the scenario in which the string that conveys the tool downhole has an obstruction in its flow path, which would otherwise limit the downhole travel of the ball. Pursuant to the technique 150, a tool is run downhole on a string that contains a flow path obstruction, pursuant to block 154. A ball is released (block 158) into the flow path from a ball dropping sub, which is located downhole of the obstruction. The ball is flowed (block 162) to cause the ball to lodge in a seat in the flow path of the string, and the flow path is pressurized to actuate the tool, pursuant to block 166.

Figure 8:
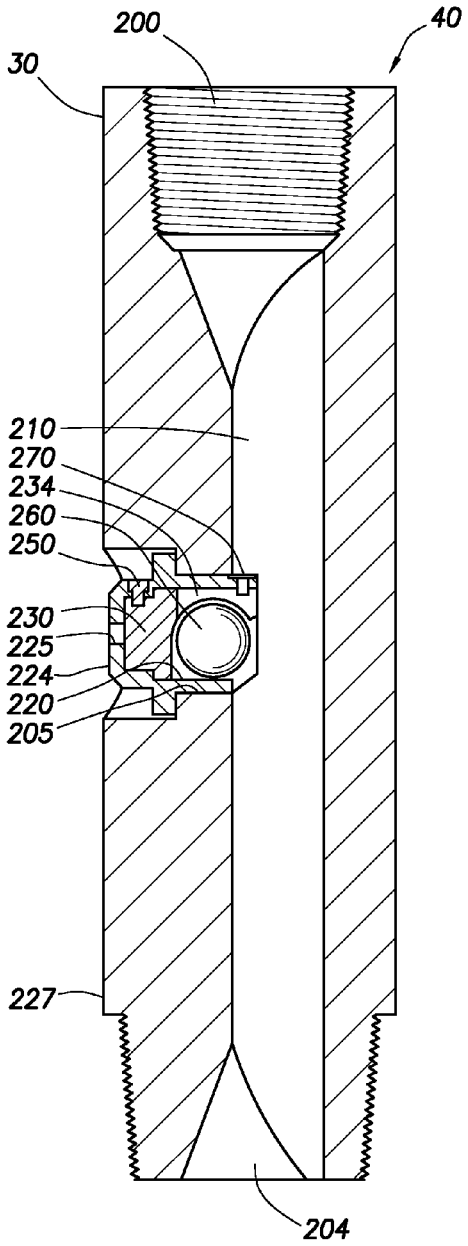
FIG. 8 is a cross-sectional view of a ball dropping sub before a ball of the sub is released according to an embodiment of the invention.

FIG. 8 depicts a cross-section of the ball dropping sub 40, in accordance with some embodiments of the invention, before a ball 260 that is retained by the sub 40 is released into the central passageway of the string 30. As shown in FIG. 8, the ball dropping sub 40 includes a longitudinal eccentric flow path 210 (i.e., eccentric with respect to the central passageway of the string 30) that forms part of the central passageway of the drill string 3. The eccentric flow path 210 extends between openings 200 and 204 that are located on either end of the flow path 210 and are concentric with the central passageway of the string 30.

The eccentric flow path 210 allows for the eccentric positioning of the ball 260 before the ball 260 is released into the central passageway of the drill string 30. More specifically, the ball 260 is disposed in a side pocket 220 that is created by a cap 224 that is disposed in a radial opening 205 in a housing 227 of the sub 40. The radial opening 205 extends between the annulus of the well and the eccentric flow path 210. A piston 230 resides inside the pocket 220 and until the ball sub 40 is actuated, the piston 230 retains the ball 260 (as depicted in FIG. 8) to prevent the ball 260 from being released into the eccentric flow path 210. The piston 230 is held in its ball retaining position by a shear pin 250 that secures the piston 230 to the cap 224, which is secured to the housing 227. The piston 230 contains curved fingers 234 (one finger 234 being shown in FIG. 8) that extend partially around the ball 260 retain the ball 260 when the piston 230 is located in the pocket 220, as depicted in FIG. 8.

The cap 224 (which may have a test port 225) generally protects the piston 230 from the surrounding wellbore environment. However, the cap 224 permits fluid communication between the annulus and the piston 230 so that upon the application of a sufficient force, which is exerted by the fluid in the annulus 15, the shear pin 250 shears to permit the piston 230 (and its fingers 234) to move into the eccentric flow path 210, as depicted in FIG. 9, to deploy the ball 260.

Figure 9:
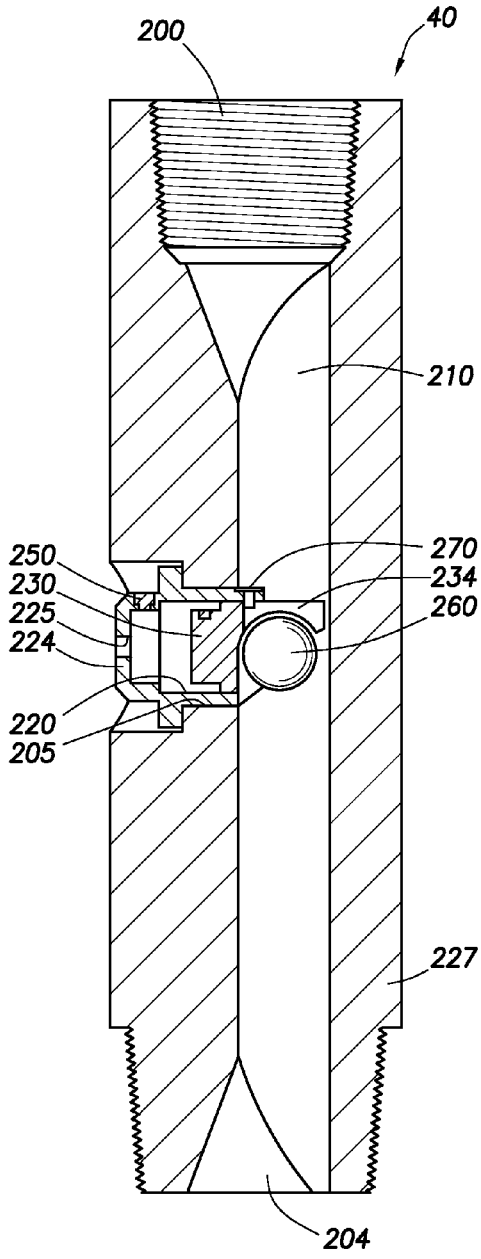
FIG. 9 is a cross-sectional view of the ball dropping sub depicting release of the ball according to an embodiment of the invention.

Referring to FIG. 9, when the piston 230 moves so that its fingers 234 extend into the flow path 210, the ball 260 is no longer retained in the pocket 220 but rather, is free to move down the eccentric flow path 210. For purposes of maintaining the correct orientation of the piston 230 (i.e., to ensure that the piston 230 does not rotate so that the fingers 234 are located below the ball 260, for example), the ball dropping sub 40 includes a pin 270 that is secured to the cap 224 and extends into a corresponding radial groove (not shown in FIGS. 8 and 9) of the piston 230. The pin 270 and groove arrangement permits linear but not rotational motion of the piston 230 with respect to the cap 224.

Figure 10:
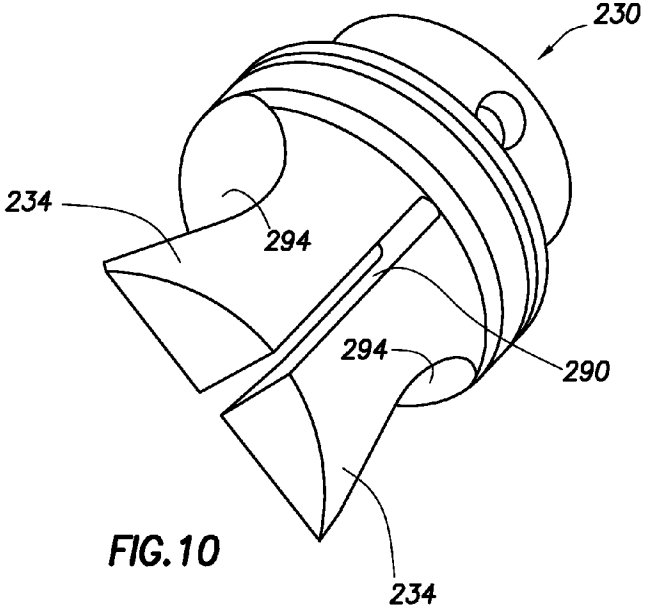
FIG. 10 is a perspective view of a piston of the ball dropping sub according to an embodiment of the invention.

Referring to FIG. 10, fluid communication through the eccentric flow path 210 is maintained even after the fingers 234 move into the eccentric flow path 210. More specifically, as depicted in FIG. 10, the fingers 234 are separated by a space 290 that allows fluid being circulated through the drill string 30 to flow through the fingers 234 and push the ball 260 out of the fingers 234. Furthermore, the fingers 234 have curved indentations 294, which are designed to further facilitate the communication of fluid past the fingers 234 when the fingers 234 extend into the flow path 210.

Figure 11:
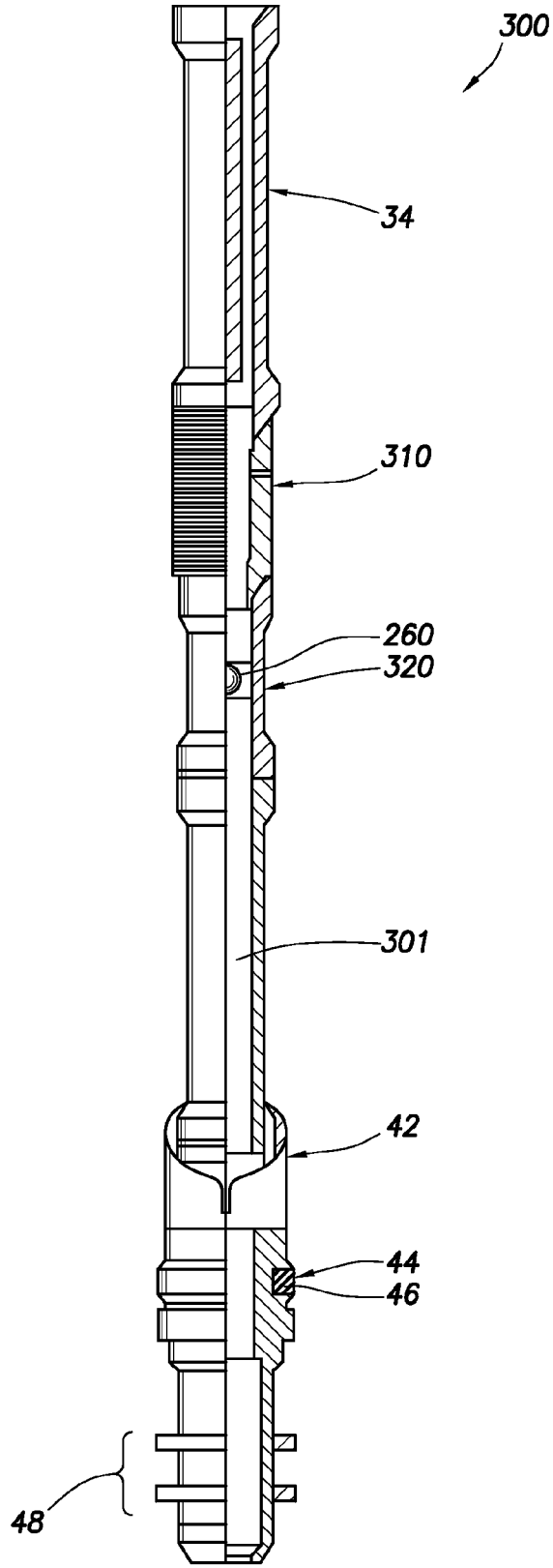
FIG. 11 is a schematic diagram of a lower assembly of a drill string according to another embodiment of the invention.

Other embodiments are within the scope of the appended claims. For example, in accordance with other embodiments of the invention, the lower assembly of the drill string 30 may be replaced by a lower assembly 300, which is depicted in FIG. 11. In general, the lower assembly 300 includes the MWD assembly 34, the packer setting tool 42, the packer 44 and the seals 48. However, unlike the lower assembly described above, the lower assembly 300 includes a circulation valve 310 and a ball dropping sub 320 (located below the MWD assembly 34 and a circulation valve 310), which is constructed to centrally retain the ball 260 in a central passageway 301 of the drill string. As described below, the ball dropping sub 320 is constructed to release the ball 260 in response to pressure inside the central passageway 301, instead of in response to pressure in the annulus.

Figure 13:
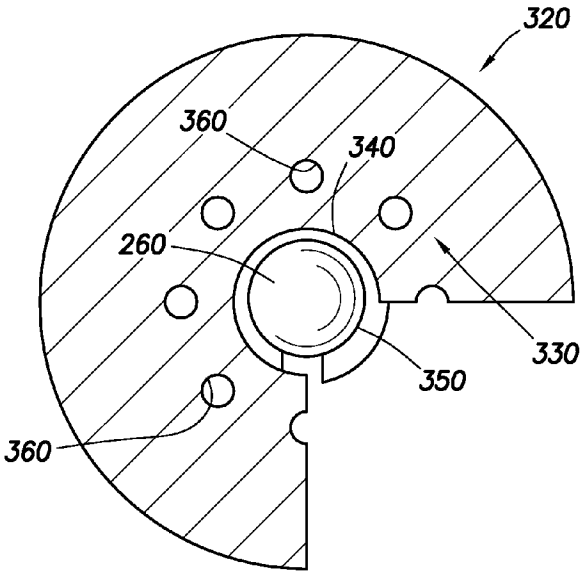
FIG. 13 is a partial cross-sectional view taken along line 13-13 of FIG. 12 according to an embodiment of the invention.
Figure 12:
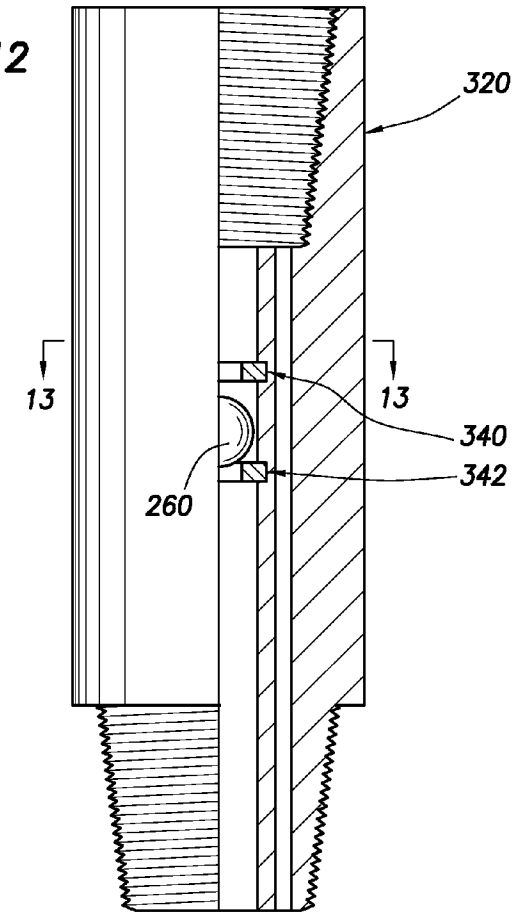
FIG. 12 is a schematic diagram of a ball dropping sub of the lower assembly of FIG. 11 according to an embodiment of the invention.

Referring to FIGS. 12 and 13, the ball dropping sub 320 includes an upper split ring 340 and a lower split ring 342, which, for the ball retaining state of the sub 320, are located above and below the ball 260, respectively, for purposes of retaining the ball 260 in a space 350 between the split rings 340 and 342. The space 350 is centrally disposed in a restricted flow section 330 that generally circumscribes the split rings 340 and 342 to limit the flow past the ball 260 when the ball 260 is retained in the space 350 and contains orifices 360 that are circumferentially disposed around the space 350.

Referring also to FIG. 11, the drill string (containing the lower assembly 300) is initially run downhole with the circulation valve 310 open. In other words, in this state, the circulation valve 310 directs the flow in the central passageway (which emerges from the MWD assembly 34) through its radial fluid communication ports and into the annulus of the well, where the flow returns to the surface of the well. Thus, during the orienting of the packer 44, part of the flow that is modulated by the MWD assembly 34 is routed through the radial circulation ports of the circulation valve 310 into the annulus, and this flow returns to the surface of the well.

Another part of the flow is communicated through the orifices 360. Due to the flow restriction that is imposed by the orifices 360, a given pressure exists above the retained ball 260, which causes a downward force to be exerted on the ball 260. However, the pressure is kept below the pressure that would otherwise force the ball 260 through the lower split ring 342, due to the fluid communication path that is provided by the open circulation valve 310.

When the lower end of the drill string is stabbed into the tie back receptacle 52 and the packer 44 is in position to be set, the circulation valve 310 is closed. In this manner, as non-limiting examples, the drill string may be manipulated in a given manner, or wired or wireless stimuli may be communicated downhole for purposes of causing the circulation valve 310 to close off the flow through its radial fluid communication ports. Due to the restricted flow path, the pressure inside the central passageway 301 above the ball 260 increases, which produces a sufficient downward force to drive the ball 260 through the lower split ring 342. Thus the closure of the circulation valve 310 causes the ball 260 to be released into the flow and descend downwardly through the central passageway into the valve seat associated with the packer setting tool 42.

It is noted that the ball (or other flowable device) may be retained in various positions relative to the string's flow path. More specifically, depending on the particular embodiment of the invention, the ball (or other flowable device) may be retained entirely inside the flow path of the drill string, partially inside the flow path or entirely outside of the flow. Furthermore, in accordance with some embodiments of the invention, the systems and techniques that are described herein may apply to strings that do not contain an obstruction to the ball (or other flowable device). For example, the ball may be retained downhole in the string for purposes of minimizing the time needed to actuate a downhole tool. In this manner, reducing the time to deploy the ball by placing the initial position of the ball relatively close to the setting tool (i.e., removing the time otherwise incurred by deploying the ball from the surface of the well) may result in significant cost savings, in view of the relatively high costs associated with drilling rig services.

As other examples of additional embodiments of the invention, a Universal Bottom Hole Orientation (UBHO) sub and a gyroscope may be used in place of the MWD assembly 34 in accordance with other embodiments of the invention. The UBHO may have an internal diameter that is sufficient to allow the ball (or other flowable device) to pass through the UBHO, unlike the MWD assembly 34. Therefore, the ball catching sub may be located above the UBHO, for example.

As yet additional examples, the systems and techniques that are disclosed herein may be used with a lower assembly that does not contain a tie back receptacle. For example, the lower zone may be plugged, and the drill string 30 may also be run plugged and thus, there may not be a need to tie back.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

running a string comprising a housing, a tool, and a flowable object held in a retained position within the housing of the string downhole in the well;

after the string is run downhole, pressurizing fluid outside the housing to release the flowable object to permit the object to flow in a flow path within the housing of the string until it is seated therein to impede fluid communication; and actuating the tool in response to the impeded fluid communication.

2. The method of claim 1, wherein the string comprises an obstruction in the flow path sized to prevent the flowable object when in the flow path from flowing past the obstruction, the method further comprising:

retaining the flowable object below the obstruction prior to the releasing of the flowable object.

3. The method of claim 2, wherein the string comprises a drill string and the obstruction is formed by a flow modulator of the drill string.

4. The method of claim 2, wherein the obstruction is formed by a pathway of a flow modulator, the method further comprising:

receiving a signal at the surface of the well generated by the flow modulator and being indicative of an orientation of the tool.

5. The method of claim 1, further comprising:

before actuation of the tool, manipulating the string to orient the tool.

6. The method of claim 5, wherein the tool comprises an oriented packer or an oriented perforating gun.

7. The method of claim 1, wherein the act of actuating the tool comprises pressurizing fluid in the primary flow path.

8. The method of claim 1, further comprising:

disposing the flowable device in a recess of a piston disposed in a pocket disposed in the housing of the string; and securing the piston in position to retain the flowable device in the string.

9. The method of claim 8, wherein the act of releasing the flowable object comprises actuating the piston to deploy the flowable device in the flow path.

10. The method of claim 9, wherein the act of actuating the piston comprises exerting pressure on an outer surface via the pressurized fluid outside the housing.

11. A method usable with a well, comprising:

running a packer downhole in the well on a drill string;

using a flow modulator of the drill string to communicate an orientation of the packer to the surface of the well;

orienting the packer in response to the communicated orientation;

downhole of the flow modulator, introducing a flowable device by pressurizing fluid outside a housing into a central passageway of the string to impede fluid communication through the string such that fluid inside the central passageway becomes pressurized; and setting the packer in response to the pressurization from the impeded fluid communication.

12. The method of claim 11, further comprising:

stabbing the string into a tie back receptacle, wherein the act of introducing the flowable device into the central passageway comprises pressurizing an annular region that surrounds the string while the string is stabbed into the receptacle.

13. The method of claim 11, wherein the act of introducing the flowable object into the central passageway comprises closing a circulation valve upstream of the flowable device to increase a pressure on the flowable device.

14. The method of claim 11, further comprising:

circulating fluid through the central passageway to flow the flowable device into a seat of string.

15. A system usable with a well, comprising:

a flowable object;

a string comprising a housing defining a flow path therein, and a tool adapted to be actuated by the flowable object; and a retaining device located in the housing of the string and comprising a piston, wherein an outer surface of the piston is in contact with fluid outside the housing, the retaining device adapted to retain the flowable object during a run in hole state of the string, wherein the retaining device is actuated by fluid pressure acting on the outer surface of the piston to release the flowable object into the flow path, thereby impeding fluid flow in the flow path and pressurizing the fluid therein, to actuate the tool.

16. The system of claim 15, wherein the retaining device is located below an obstruction in the flow path sized to prevent the flowable object from flowing past the obstruction.

17. The system of claim 15, wherein the flowable object is adapted to lodge in a seat of the flow path when released, the system further comprising:

a setting tool adapted to respond to pressurization of the flow path when the flowable object is lodged in the seat to actuate the other tool.

18. The system of claim 15, wherein the tool comprises a packer, a whipstock or a perforating gun.

19. A system usable with a well, comprising:

a drill string comprising a flow modulator, a packer setting tools and a packer; and a retaining device located in the string downhole of the flow modulator, the retaining device that selectively retains a flowable object outside of a central passageway of the string and release the flowable object into the central passageway based on a pressure in an annular region outside of the retaining device exceeding a pressure threshold, wherein the flowable object, after being released into the central passageway, lodges in a seat in the central passageway to block fluid flow and build fluid pressure therein, and wherein the packer setting tool is actuated by the fluid pressure to set the packer.

20. A system usable with a well, comprising:

a drill string comprising a flow modulator, a packer setting tool and a packer;

a circulation valve adapted to be open and closed; and a retaining device located in the string downhole of the flow modulator, the retaining device adapted to selectively retain a flowable object and release the flowable object into a central passageway of the string in response to the circulation valve closing, wherein the flowable object, after being released into the central passageway, lodges in a seat in the central passageway to block fluid flow and build fluid pressure therein, wherein the packer setting tool is actuated by the fluid pressure to set the packer.

* * * * *